US005443204A

United States Patent [19]

O'Donnell et al.

[11] Patent Number: 5,443,204

[45] Date of Patent: Aug. 22, 1995

[54] PACKAGE WITH RECLOSABLE LID

[75] Inventors: Brian D. O'Donnell, Columbia; Donald C. Secrist, Centralia; William H. Nottke, St. Louis, all of Mo.

[73] Assignee: Hubbell Incorporated, Orange, Conn.

[21] Appl. No.: 233,780

[22] Filed: Apr. 26, 1994

[51] Int. Cl.[6] ..... B65D 5/72

[52] U.S. Cl. ..... 229/242; 229/122; 221/305

[58] Field of Search ..... 229/104, 122, 122.1, 229/240, 242; 221/305, 306; 206/443

[56] References Cited

U.S. PATENT DOCUMENTS

| | | | |
|---|---|---|---|
| 2,005,924 | 6/1935 | Wilson | 229/122.1 |
| 2,765,906 | 10/1956 | Rossum | 221/305 |
| 2,866,588 | 12/1958 | Bolding | 229/104 |
| 2,996,344 | 8/1961 | Garman | 229/122 |
| 4,039,118 | 8/1977 | Kawaoka | 229/122.1 |
| 5,020,719 | 6/1991 | Roth et al. | 229/122.1 |
| 5,137,211 | 8/1992 | Summer et al. | 229/122 |
| 5,249,737 | 10/1993 | Fritz et al. | 229/122.1 |

FOREIGN PATENT DOCUMENTS

| | | | |
|---|---|---|---|
| 473909 | 3/1992 | European Pat. Off. | 229/122 |
| 1057262 | 3/1954 | France | 229/122.1 |
| 933333 | 8/1963 | United Kingdom | 229/122.1 |

OTHER PUBLICATIONS

Kearney Protection Products, Section 030, Jun., 1990 Fuse Links, pp. 1–8.

*Primary Examiner*—Gary E. Elkins

[57] ABSTRACT

A low-cost paperboard carton (22) for multiple elongated articles such as fuselinks (24) is provided which can be readily stored on utility service trucks and permit ready access to the articles therein. The carton (22) includes a pair of spaced apart sidewalls (26, 98) with a spanning front panel (78); the panel (78) and sidewalls (26, 98) are configured to present a forward opening (146) as well as rearwardly extending recesses (148, 150) in the sidewalls (26, 98). A removable die cut insert (142) initially fills the opening (146) and recesses (148, 150), and can be removed to open the carton (22). Preferably, an inclined support panel (65) is disposed within the confines of the carton (22) and extends rearwardly from the opening (146). The fuse links (24) are thus positioned in an inclined relationship for ready access by the user through the opening (146) and recesses (148, 150).

6 Claims, 5 Drawing Sheets

PACKAGE WITH RECLOSABLE LID

BACKGROUND OF THE INVENTION

1. Field of the Invention

The present invention is broadly concerned with an improved dispenser carton for elongated articles such as replacement fuse links used by electrical utilities. More particularly, the invention pertains to such a dispenser carton which is especially configured for maintaining links within a cavity in an orientation for ready viewing and access thereto; to this end, the dispenser carton of the invention includes walls defining an upright cavity and presenting an open front panel, the latter equipped with a releasable locking panel or tab to retain the links within the cavity while permitting access thereto when a link is needed.

2. Description of the Prior Art

It is a common practice in the electrical utility industry to provide service trucks with a large number of replacement fuse links. These are needed for repairs of electrical cutouts or similar apparatus and must be accessible on the service truck by utility linemen, in order that electrical service can be rapidly restored. Fuse links of this type come in a number of different sizes and have differing electrical characteristics, and there are at least 15 different types of fuse links which must be normally carried by utility service vehicles.

In light of these considerations, it is common for replacement fuse links to be kept in individual cartons on racks within utility service trucks. The most popular type of carton heretofore available is designed to hold five individually boxed fuse links, with each individual box bearing identifying information about the link therein. While these types of prior cartons are widely used, and provide ready access to individual links, they present a number of problems. First, this type of packaging is relatively expensive, and different sizes of individual fuse link boxes are required for certain types of links. Thus, the inherent expense involved in the use of these cartons and boxes is increased owing to the fact that the packaging is not universal for all types of fuse links normally carried within a utility truck. Despite these drawbacks, the prior packaging has achieved such a degree of acceptance in the industry that many utility vehicles have specialized racks for holding these cartons.

There is therefore a need in the art for an improved, lower cost packaging system for fuse links which can be used in lieu of today's standard packaging without the necessity of modification of utility truck storage racks; at the same time, the improved packaging must provide ready access to the fuse links while preventing inadvertent spillage of the links during travel of the service vehicles.

SUMMARY OF THE INVENTION

The present invention overcomes the problems outlined above and provides an improved dispenser carton for elongated articles such as fuse links. The carton comprises walls defining an upright, elongated cavity for receiving articles to be dispensed. The carton-defining walls include a pair of spaced apart, opposed sidewalls each presenting forward, rearward, upper and lower margins, and a front wall spanning the forward margins of the sidewalls. Structure is provided to define an opening in the front wall, as well as communicating recesses in each of the sidewalls extending rearwardly from the sidewall front margins. The opening and recesses are located above the sidewall bottom margins and are configured for viewing of articles within the cavity while permitting selective manual removal of articles therefrom. A retainer flap at least partially covering the front wall opening is provided for preventing inadvertent loss of articles from the cavity. This flap is selectively shiftable away from the front panel as necessary to permit easy removal of articles from the cavity. In order to support the articles within the cavity at an appropriate level for ease of removal, a bottom wall is provided within the cavity which is above the sidewall bottom margins and proximal to the front wall opening and sidewalls recesses.

In preferred forms, the retainer flap presents an upper end which is engageable with the front panel for releasably maintaining the retainer flap across the opening. At the same time, the retainer flap may be readily pulled out of engagement with the front panel to provide access.

In addition, the article-supporting bottom wall within the cavity is advantageously inclined from the front panel downwardly toward the sidewall rear margins. This insures that the elongated fuse links or other articles are maintained in an inclined orientation with their ends proximal to the front panel opening and sidewall recesses. This insures that a user can readily grasp one or more articles as needed, even while wearing bulky lineman's gloves.

The preferred carton of the invention also includes a top panel spanning the upper margins of the sidewalls and a rear panel spanning the rearward margins of the sidewalls. Cooperating tab and slot locking means are carried by the walls in order to allow assembly of the carton from a blank, and for maintaining the walls in the cavity-defining relationship thereof.

In practice, the carton is designed with a die cut segment extending across the front panel and a portion of each of the sidewalls; this segment can be readily removed from the carton proper when the carton is ready for use, thereby creating the desired front panel opening and sidewalls recesses.

DETAILED DESCRIPTION OF THE PREFERRED EMBODIMENTS

Figure 1:
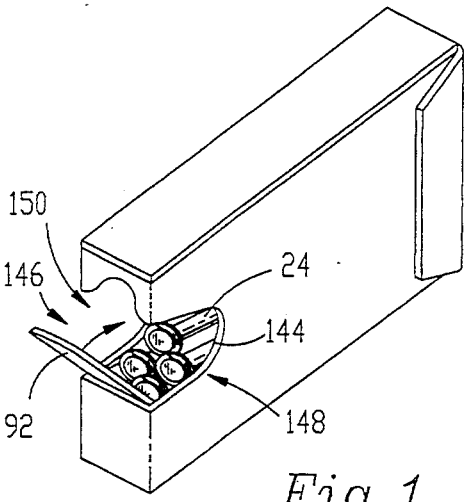
FIG. 1 is a perspective view of a dispenser carton in accordance with the invention, shown with a supply of elongated fuse links therein and illustrating the operation of the front panel retainer flap.
Figure 2:
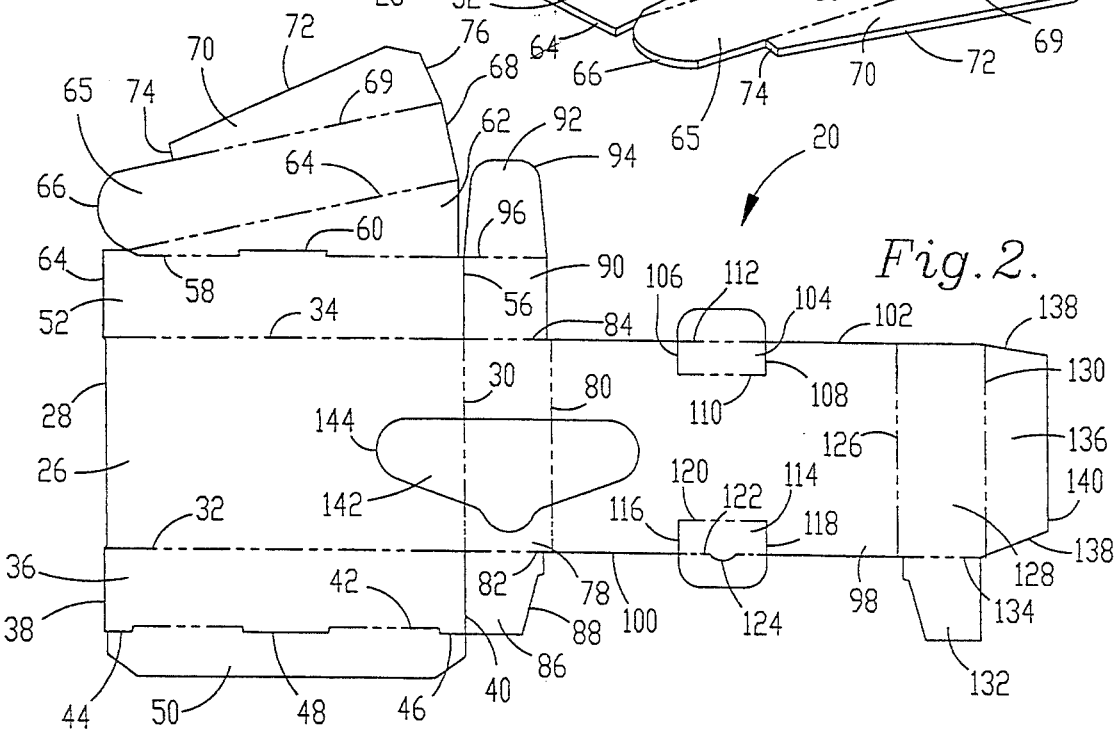
FIG. 2 is a plan view of the carton blank used in the formation of the carton of FIG. 1.

Turning now to the drawings, and particularly FIG. 2, a unitary paperboard blank 20 is illustrated. The blank 20 is employed to fabricate a completed carton 22 (see FIG. 1) for elongated articles such as fuse links 24 stored within the carton.

The blank 20 is composed of a series of interconnected panels defined by edge margins and fold lines. In particular, it will be observed that the blank 20 includes a first sidewall panel 26 having a rearmost margin 28 and being defined at its forward margin by a transverse fold line 30. Likewise, upper and lower fold axially extending lines 32, 34 define the corresponding upper and lower margins of first sidewall panel 26. A top panel 36 is connected to the top margin 32 of panel 26 and presents a rear edge 38. A cut line 40, coincident with fold line 30, defines the forward edge of top panel 36. The elongated margin of top panel 36 spaced from fold line 32 is defined by a fold line 42 interrupted by endmost cut lines 44, 46 and central cut line 48. A connecting flap 50 is secured to top panel 36 by the fold line 42 as shown.

A bottom panel 52 extends from and is connected to the lower margin of first sidewall panel 26. The bottom panel 52 includes a rearmost edge 54, whereas the forward edge of the bottom panel is defined by cut line 56 coincident with fold line 30. The opposite elongated margin of bottom panel 52 remote from fold line 34 is defined by fold line 58 interrupted by central cut 60.

A generally triangularly-shaped support panel 62 is connected to the margin of bottom panel 52 remote from fold line 34, and presents an obliquely oriented fold line 64 as shown. An elongated, oblique article-supporting panel 65 is connected to support panel 62 by means of fold line 64, and presents a rounded rearmost edge 66 as well as a rectilinear front edge 68 at a right angle to fold line 64. The opposite margin of panel 65 is defined by a fold line 69 parallel with fold line 64. A secondary, somewhat triangularly-shaped support panel 70 is secured to the margin of panel 65 remote from fold line 64, and includes an oblique side margin 72 as well as end margins 74, 76.

A front panel 78 is formed as an extension of first sidewall panel 26 and is defined by fold line 30 as well as spaced, parallel fold line 80. The upper and lower margins of front panel 78 are defined by fold lines 82 and 84 as shown. A top flap 86 presenting an oblique forward edge 88 is secured to and extends from the upper margin of front panel 78. A retainer flap 90 extends from the lower margin of front panel 78 and presents an upper end 92 having rounded corners 94. An intermediate fold line 96, parallel with fold line 84, extends across the width of retainer flap 90 as illustrated.

Second sidewall panel 98 extends from fold line 80 and presents upper and lower edges 100, 102 which are coincident with fold lines 32, 34. A locking tab 104, defined by spaced cut lines 106, 108 and parallel fold lines 110, 112 is provided adjacent upper margin 102 and spaced from fold line 80. A secondary locking tab 114 is provided adjacent upper edge 100, and is defined by spaced, parallel cut lines 116, 118 as well as transverse fold lines 120, 122. The latter is interrupted by an arcuate cut line 124 as shown.

The rearward margin of secondary sidewall panel 98 is defined by a fold line 126 parallel with fold line 80. A rear panel 128 extends from fold line 126 and is defined between fold lines 126 and 130. A closure flap 132 extends from the upper margin of rear panel 128, with a fold line 134 defining the juncture between these sections. Finally, a generally trapezoidal closure flap 136 extends from fold line 130 and presents inclined side margins 138 and end margin 140.

The blank 20 is completed by provision of a die cut, detachable segment 142 which spans front panel 78 and extends from fold lines 30 and 80 along the length of the corresponding first and second sidewall panels 26, 98. To this end, a continuous die cut line 144 extends across the front panel 78 and into each of the sidewall panels 26, 98. Segment 142 is thus detachable from the remainder of the blank.

The blank 20 is used to fabricate a completed carton 22. The sequence of steps involved in this fabrication are set forth in detail in FIGS. 3–16. These Figures clearly depict the folding of blank 20 necessary to create the carton 22, but these steps will nevertheless be briefly described to facilitate a complete understanding of the invention.

Figure 4:
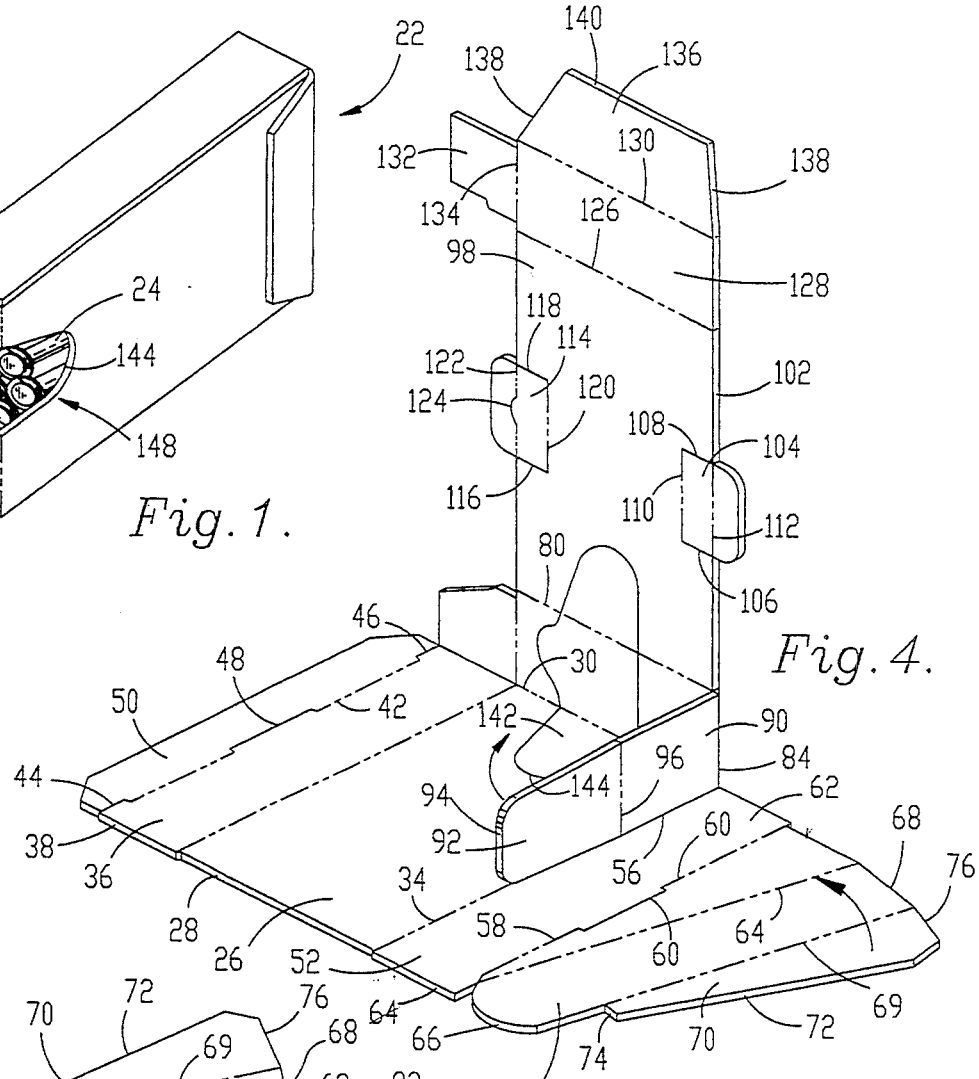
FIG. 4 is a view similar to that of FIG. 3 and illustrating the next step in carton fabrication wherein the retainer flap folded towards the front panel.
Figures 3, 5:
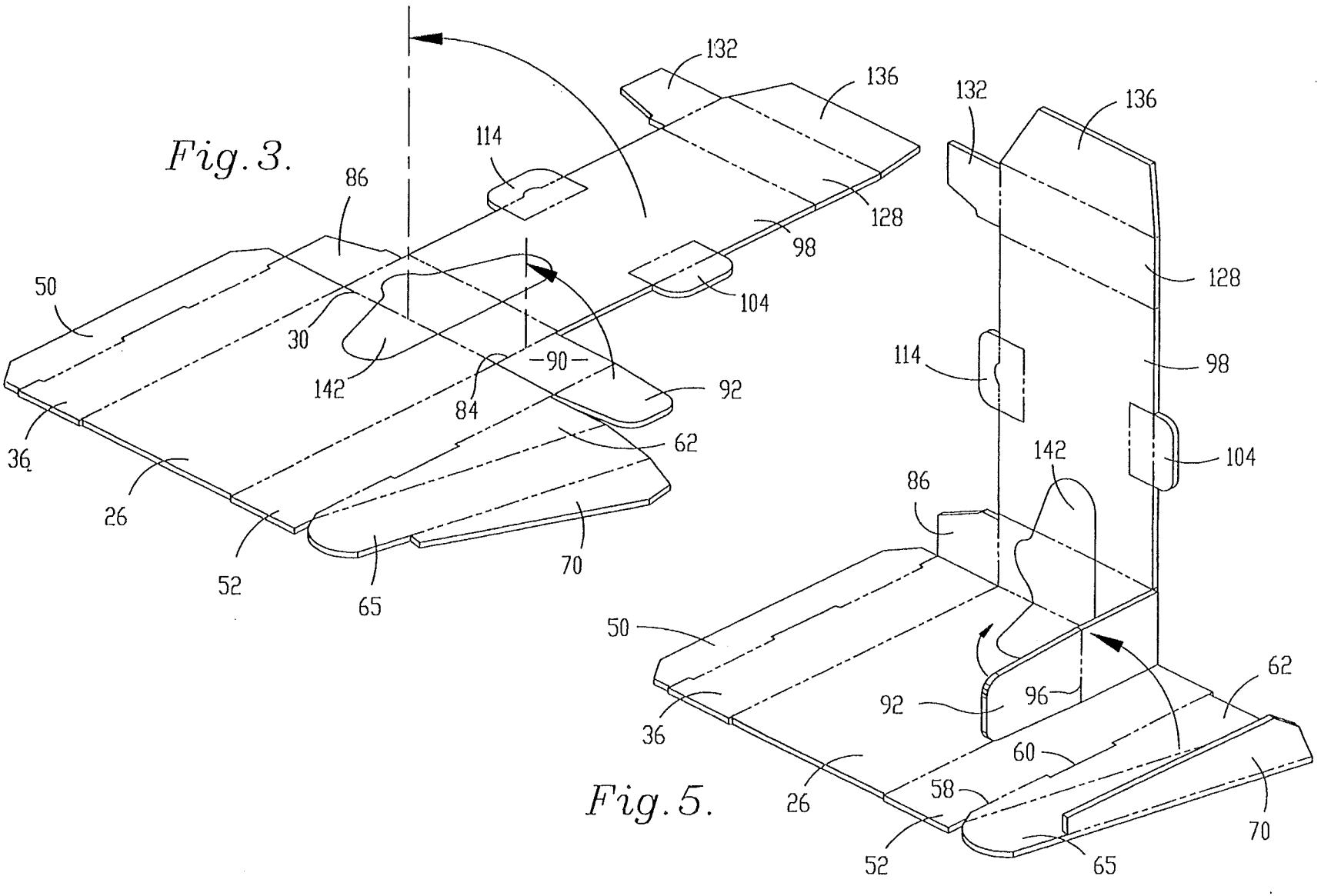
FIG. 3 is a perspective view illustrating the first step in fabrication of the carton using the blank, i.e., initial folding of the retainer flap and one sidewall panel of the blank.
FIG. 5 is a view similar to that of FIG. 4, but depicting initial folding of the inclined article-supporting bottom wall-defining flaps of the carton.

Referring first to FIG. 3, it will be see that the first step in carton fabrication involves folding blank 20 about fold lines 30 and 32 so that the blank assumes the configuration of FIG. 4, i.e., with panel 98 at essentially a right angle relative to panel 26, and with retainer flap 90 folded inwardly into general alignment with fold line 34.

Figure 8:
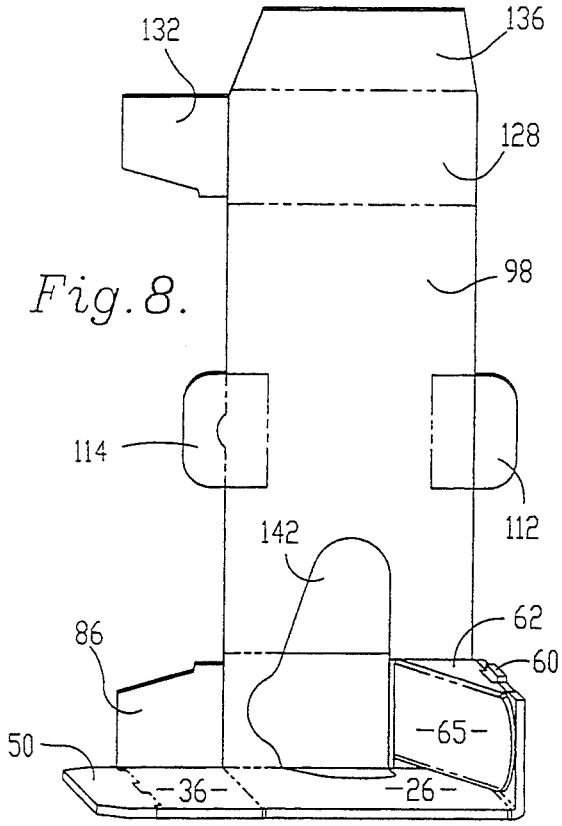
FIG. 8 is a view similar to that of FIG. 7, and showing the configuration of the blank with the inclined, article-supporting bottom panel in place.
Figure 7:
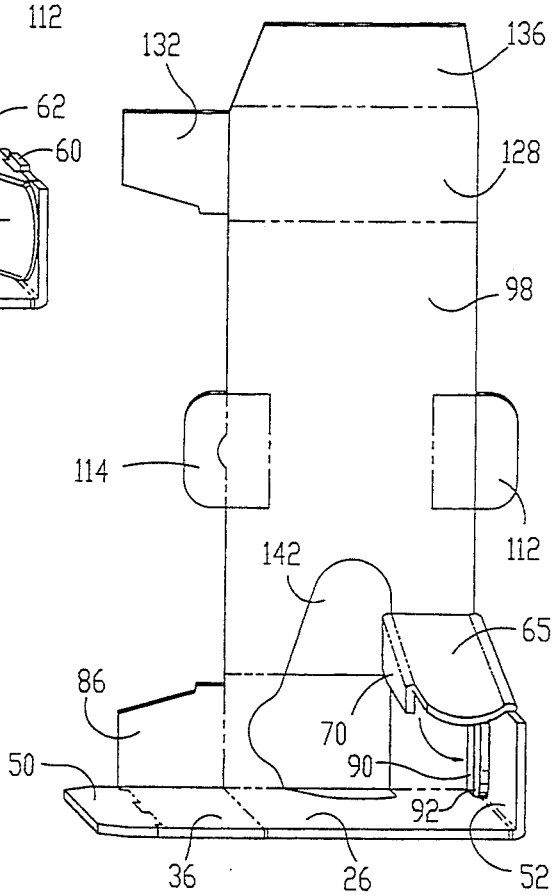
FIG. 7 is a view similar to that of FIG. 6 and depicting the next folding step during formation of the inclined, article-supporting bottom panel.
Figure 6:
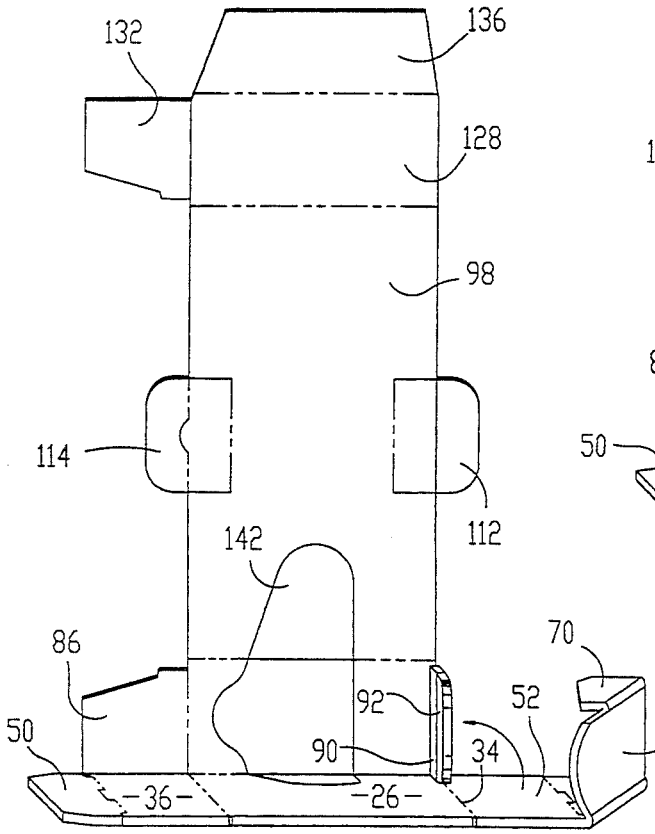
FIG. 6 is a front view illustrating the next step in carton fabrication wherein the bottom panel of the carton is folded upwardly toward the article retaining flap.

In the next step (see FIGS. 4–8), the support panel 70 is first folded upwardly along fold line 69, followed by folds along the lines 64, 58 and 34 until support panel 65 is positioned as illustrated in FIG. 8, i.e., with the upper rectilinear edge 68 thereof adjacent cut line 142, and with the panel 65 sloping rearwardly therefrom.

Figure 12:
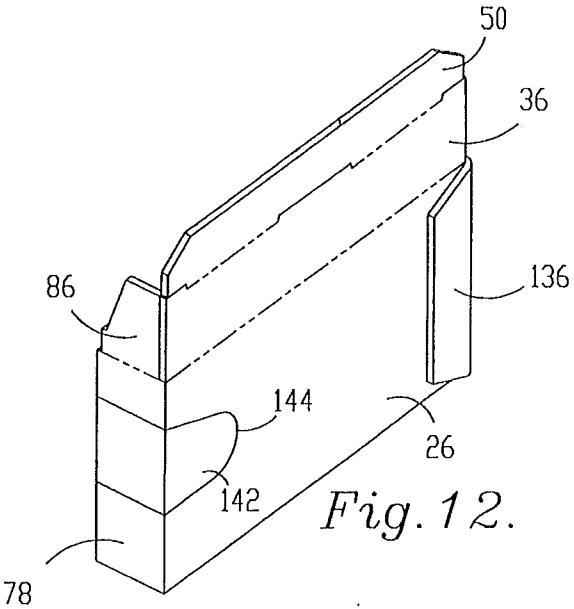
FIG. 12 is a perspective view of the blank showing the upstanding top panel prior to folding and insertion thereof.
Figure 11:
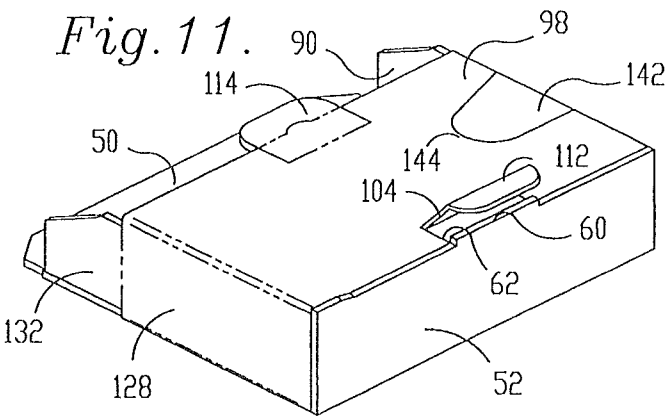
FIG. 11 is a view similar to that of FIG. 10, but illustrating the insertion of the locking tabs of the carton.
Figure 10:
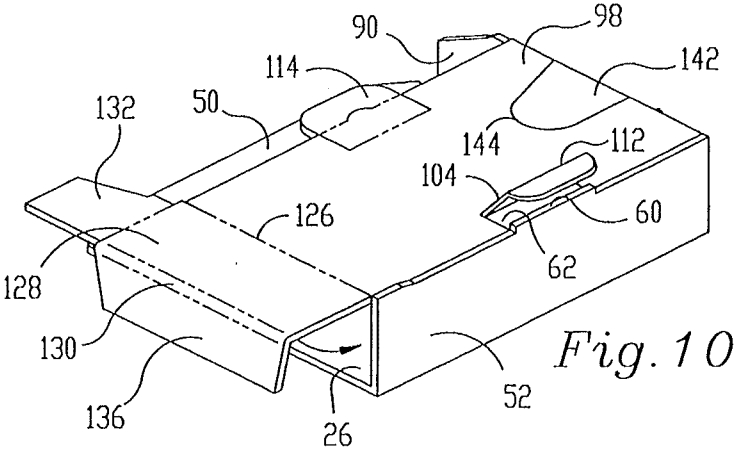
FIG. 10 is a view similar to that of FIG. 9, but illustrating the insertion of .the rear panel of the box between the sidewall panels and in spanning relationship thereto.
Figure 9:
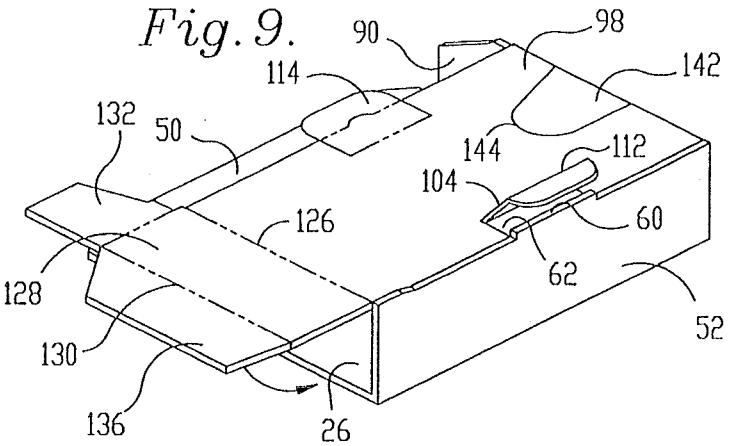
FIG. 9 is a perspective view depicting the next step in carton fabrication wherein the sidewall panels are folded into spaced, opposed relationship.
Figure 14:
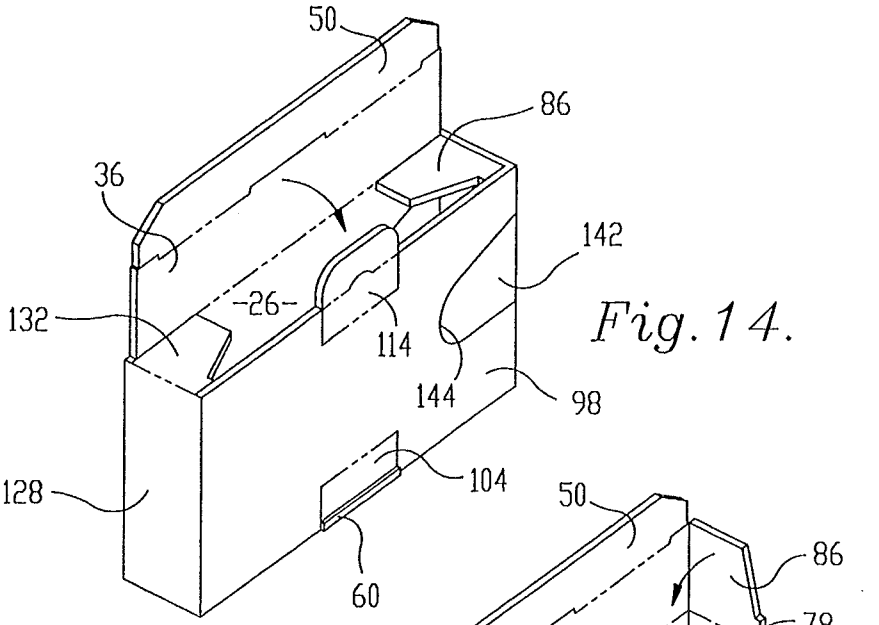
FIG. 14 is a view similar to that of FIG. 13, and illustrating downward folding of the top panel.
Figure 13:
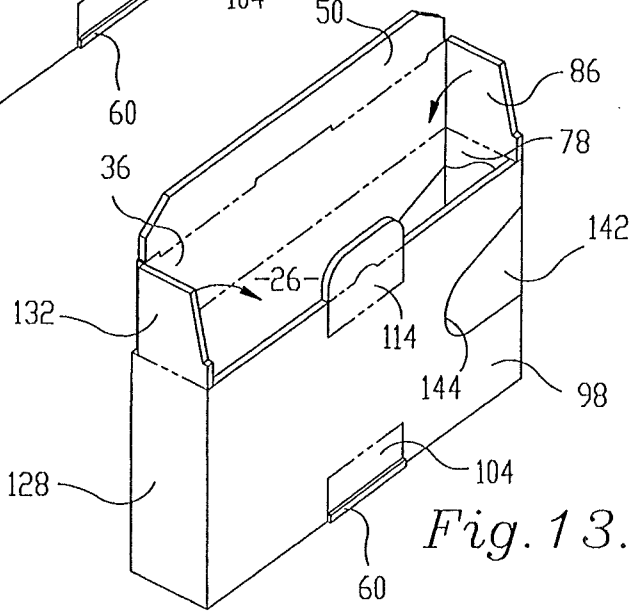
FIG. 13 is a view similar to that of FIG. 12, but illustrating inward folding of the top panel end flaps between the opposed sidewall panels.

Referring next to FIG. 9, the panel 98 is folded along line 80 until it is substantially parallel with panel 26. Thereupon (see FIGS. 10–12), the rear panel 128 and closure flap 136 are folded along respective lines 126 and 130 until panel 128 bridges the rearward margins of the panels 26 and 28 and closes the rearward end of the carton. As best seen in FIG. 12, the closure flap 36 is positioned against the exterior face of panel 26, and is glued thereto by using a conventional adhesive. Next, the locking tab 104 is inserted into cut 60 to complete the bottom section of the carton. This leaves an open-topped carton as best seen in FIG. 12, which is ready for filling with elongated article such as the fuse links 24.

Once filled, the carton is completed (see FIGS. 13–15) by inward folding of the flaps 86 and 132, followed by folding of the top panel 36 and connecting flap 50 over the upper end of the carton, with the flap 50 being inserted within the confines .of the article-receiving chamber, i.e., the flap 50 abuts the inner surface of panel 98. At this point, the locking tab 114 is inserted cut line 48 to complete the closure of the upper end of the carton.

Figure 15:
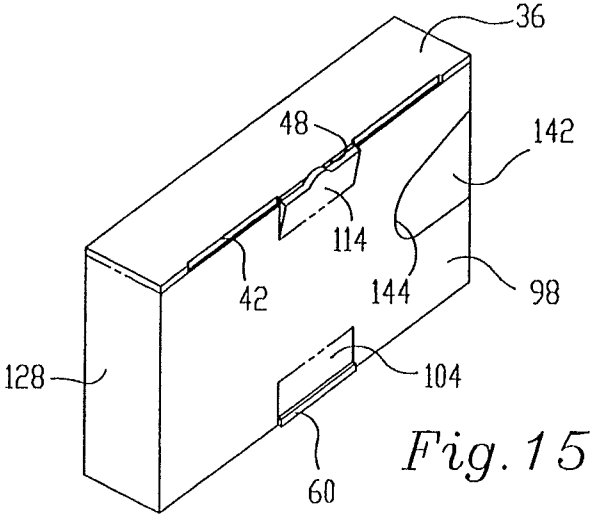
FIG. 15 is a perspective view of the completed carton as it would appear when filled with articles and shipped to a user.

The filled carton thus has the appearance illustrated in FIG. 15, and is ready for storage and shipping for customer use. In this orientation, the carton is completely closed and can be handled in the usual fashion.

Figure 16:
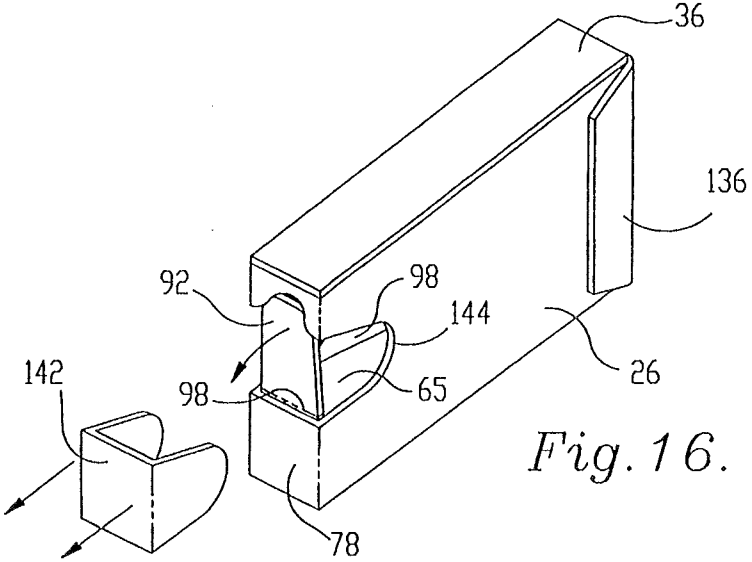
FIG. 16 is a perspective view of the completed, filled carton, and showing removal of the die cut insert to present the front panel opening and sidewall recesses.

When it is desired to use carton 22, it is only necessary to manually remove segment 142 as illustrated in FIG. 16. This can readily be done by applying light finger pressure to the die cut segment. When removed, the carton 22 presents a front opening 146 across panel 78, as well as rearwardly extending recesses 148, 150 in the panels 26, 98. Furthermore, the upper end of retainer flap 90 is positioned across opening 146, with the upper end 192 of the flap 90 being in engagement with the upper defining margin of front panel 78. In this form, the articles within carton 22 can be readily viewed through the recesses 148, 150. When it is desired to remove one or more of these articles, it is only necessary to pivot retainer flap 90 forwardly along transverse fold line 96, which is positioned closely adjacent the lower margin of cut line 144 traversing end panel 78. When the articles are removed, the flap 90 is pivoted back to assume the FIG. 16 position thereof where the upper end 92 is retained in place by the upper end of the front panel 78.

Carton 22 is considerably less expensive than the cartons of the prior art. This stems from the fact that a much simpler construction is employed, and also because each of the cartons 22 holds ten fuse links. Further, owing to the construction of carton 22, the individual fuse links may be encased within bags which retard the degradation through aging of the fuse links. Of course, these bags are typically provided with indicia pertaining to the electrical characteristics of the fuse links, and such information may also be imprinted on front panel 78 of carton 22 or any other convenient, visually viewable of the carton. Finally, provision of the preferred internal article-supporting panel 56 assures that the fuse links 24 are maintained within carton 22 in an orientation permitting easy removal. As illustrated in FIG. 1, the inclined links 24 can be readily removed, even by a lineman wearing insulative gloves.

We claim:

1. A dispenser carton for elongated articles comprising walls defining an upright, elongated cavity for receiving said articles to be dispensed, said walls including a pair of spaced apart, opposed sidewalls each having a forward margin, a rearward margin, an upper margin and a lower margin, a front wall spanning the forward margins of said sidewalls, structure defining an opening in said front wall and a respective recess in each of said sidewalls extending rearwardly from each corresponding front margin adjacent said opening, said opening and recesses being located above said sidewall bottom margins and configured for viewing of said articles within the cavity and permitting selective manual removal of articles therefrom, a retainer flap at least partially covering said opening for preventing inadvertent loss of articles from said cavity, said flap being selectively shiftable away from said front wall, and an article-supporting bottom wall within said cavity above said sidewall bottom margins and proximal to said opening and recesses for supporting said articles within the cavity at a level for dispensing thereof, said retainer flap having an upper end engageable with said front wall for releasably maintaining the retainer flap across said opening.

2. The carton of claim 1, said bottom wall being inclined from said front wall downwardly toward said sidewall rear margins.

3. The carton of claim 1, said walls including a top panel spanning the upper margins of said sidewalls, and a rear panel spanning the rearward margins of said sidewalls.

4. A dispenser carton for elongated articles comprising walls defining an upright, elongated cavity for receiving said articles to be dispensed, said walls including a pair of spaced apart, opposed sidewalls each having a forward margin, a rearward margin, an upper margin and a lower margin, a front wall spanning the forward margins of said sidewalls, structure defining an opening in said front wall and a respective recess in each of said sidewalls extending rearwardly from each corresponding front margin adjacent said opening, said opening and recesses being located above said sidewall bottom margins and configured for viewing of said articles within the cavity and permitting selective manual removal of articles therefrom, a retainer flap at least partially covering said opening for preventing inadvertent loss of articles from said cavity, said flap being selectively shiftable away from said front wall, and an article-supporting bottom wall within said cavity above said sidewall bottom margins and proximal to said opening and recesses for supporting said articles within the cavity at a level for dispensing thereof, said opening and recesses being initially filled with a segment completely detachable from said carton to present said recesses and opening when the carton is opened for use.

5. The carton of claim 1, said walls being formed of paperboard stock.

6. The carton of claim 1, including cooperating tab and slot locking means carried by said walls for maintaining the walls in the cavity-defining relationship thereof.

* * * * *